US010330415B2

(12) United States Patent
Niswander et al.

(10) Patent No.: US 10,330,415 B2
(45) Date of Patent: Jun. 25, 2019

(54) TRIGGER BAR FOR A FIREARM

(71) Applicant: AGENCY ARMS, LLC, Camarillo, CA (US)

(72) Inventors: Randy Paul Niswander, Oxnard, CA (US); Michael Lee Parks, Canyon Country, CA (US)

(73) Assignee: Agency Arms, LLC, Ventura, CA (US)

( * ) Notice: Subject to any disclaimer, the term of this patent is extended or adjusted under 35 U.S.C. 154(b) by 0 days.

(21) Appl. No.: 15/949,966

(22) Filed: Apr. 10, 2018

(65) Prior Publication Data

US 2018/0292157 A1 Oct. 11, 2018

Related U.S. Application Data

(60) Provisional application No. 62/483,928, filed on Apr. 10, 2017.

(51) Int. Cl.

| | |
|---|---|
| ***F41A 19/16*** | (2006.01) |
| ***F41A 19/10*** | (2006.01) |
| ***F41A 19/06*** | (2006.01) |
| *F41A 19/17* | (2006.01) |

(52) U.S. Cl.

CPC ..... *F41A 19/16* (2013.01); *F41A 19/06* (2013.01); *F41A 19/10* (2013.01); *F41A 19/17* (2013.01)

(58) Field of Classification Search

CPC ..... F41A 19/06; F41A 19/10; F41A 19/17; F41A 19/16; F41A 19/12

USPC ..... 42/69.01

See application file for complete search history.

(56) References Cited

U.S. PATENT DOCUMENTS

| | | | | |
|---|---|---|---|---|
| 10,113,821 | B1 * | 10/2018 | Pavlick | F41A 19/10 |
| 2012/0167426 | A1 * | 7/2012 | O'Clair | F41A 11/02 42/14 |
| 2013/0340309 | A1 * | 12/2013 | Lee | F41A 17/46 42/69.01 |
| 2014/0215880 | A1 * | 8/2014 | Zukowski | F41A 17/36 42/70.02 |
| 2015/0027020 | A1 * | 1/2015 | Sheets, Jr. | F41A 17/00 42/70.11 |
| 2015/0211822 | A1 * | 7/2015 | Hirschheiter | F41A 19/10 42/69.01 |
| 2016/0348995 | A1 * | 12/2016 | Parajon | F41A 19/10 |
| 2016/0356568 | A1 * | 12/2016 | Kuracina | F41A 19/30 |

(Continued)

FOREIGN PATENT DOCUMENTS

| | | | | |
|---|---|---|---|---|
| WO | WO-2018158742 | A1 * | 9/2018 | F41A 19/31 |

OTHER PUBLICATIONS

NPL1: wing tactical https://www.wingtactical.com/firearm-parts/handgun/pistol-trigger-parts/cmc-drop-in-flat-trigger-for-glock/.*

(Continued)

*Primary Examiner* — John Cooper

(74) *Attorney, Agent, or Firm* — Eversheds Sutherland (US) LLP

(57) ABSTRACT

Systems and methods for reducing or removing trigger slack in a firearm are disclosed. In some instances, a method comprises positioning a plunger safety tab to a front end of a body of a trigger bar. The plunger safety is positioned more forward on the body relative to an OEM plunger safety tab. The method also includes positioning a cruciform coupled to the rear end of the body. The cruciform is positioned more forward on the body relative to an OEM cruciform.

20 Claims, 4 Drawing Sheets

(56) References Cited

U.S. PATENT DOCUMENTS

| | | | | |
|---|---|---|---|---|
| 2017/0321982 | A1* | 11/2017 | Gray | F41A 19/31 |
| 2018/0274872 | A1* | 9/2018 | Zukowski | F41A 19/44 |
| 2019/0025000 | A1* | 1/2019 | Bascom | F41A 19/06 |
| 2019/0041149 | A1* | 2/2019 | Cusano | F41A 19/30 |

OTHER PUBLICATIONS

NPL2: "Glock triggers compared" http://minivandoorgunner.blogspot.com/2016/08/glock-triggers-compared-agency-apex-w.html Aug. 25, 2016.*

NPL3: Vanek Custom trigger; https://web.archive.org/web/20160316093456/http://www.vanekcustom.com/11.html Mar. 16, 2016.*

* cited by examiner

TRIGGER BAR FOR A FIREARM

CROSS-REFERENCE TO RELATED APPLICATIONS

The disclosure claims priority to and the benefit of U.S. Provisional Application No. 62/483,928, filed Apr. 10, 2017, which is hereby incorporated by reference herein in its entirety.

FIELD OF THE DISCLOSURE

The disclosure relates to firearms, and more particularly relates to a trigger bar configured to reduce or eliminate trigger slack.

BACKGROUND

Trigger slack is any "positive" movement of the trigger (i.e., pulling of the trigger) that does not cause the sear to move and does not engage the mainspring. In this manner, trigger slack is the initial movement from a resting position of the trigger up to the point where the shooter feels resistance. In some instances, trigger slack may be undesirable.

SUMMARY

Some or all of the above needs and/or problems may be addressed by certain embodiments of the systems and methods for reducing or removing trigger slack in a firearm disclosed herein. In some instances, a method comprises positioning a plunger safety tab to a front end of a body of a trigger bar. The plunger safety is positioned more forward on the body relative to an OEM plunger safety tab. The method also includes positioning a cruciform coupled to the rear end of the body. The cruciform is positioned more forward on the body relative to an OEM cruciform.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

FIG. 2(*b*) depicts a trigger bar for reducing or removing the trigger slack of a firearm in accordance with one or more embodiments of the disclosure.

DETAILED DESCRIPTION

The disclosure provides systems and methods for safely and easily reducing or removing trigger slack from pistols (such as Glock® pistols) without circumventing the mechanical safeties of the firearm. For example, in one embodiment, one or more portions of the trigger bar are reconfigured within the trigger shoe such that trigger slack is reduced or removed without compromising any of the mechanical safeties of the pistol safety system. In some instances, the pistol may be a Glock® pistol or the like. Any suitable pistol may be used.

Figure 1A:
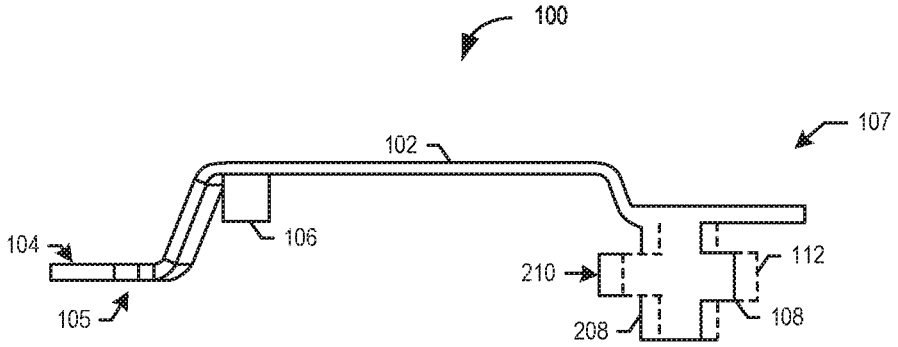
FIG. 1A depicts a trigger bar for reducing or removing the trigger slack of a firearm in accordance with one or more embodiments of the disclosure.
Figure 1B:
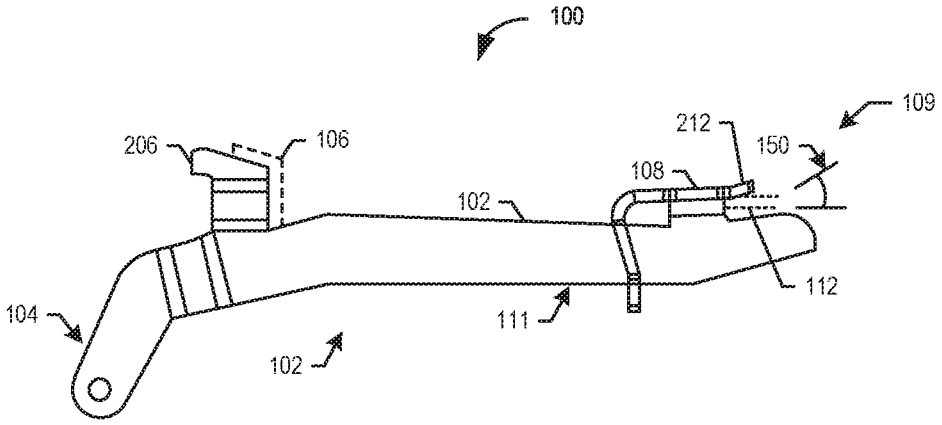
FIG. 1B depicts a trigger bar for reducing or removing the trigger slack of a firearm in accordance with one or more embodiments of the disclosure.

FIGS. 1A and 1B depict an OEM trigger bar 100 with the repositioned components of the trigger bar shown in solid lines and the original positioned components shown in dashed lines to illustrate the relative repositioning of the repositioned components relative to the OEM position of the components. As shown in FIGS. 1A and 1B, the OEM trigger bar 100 may include a body 102, a lateral extending leg 104, a plunger safety tab 106, and a cruciform 108. The lateral extending leg 104 is configured to engage a trigger shoe. The plunger safety tab 106 is configured to engage a striker safety pin. The cruciform 108 is configured to engage a firing pin lug on a striker assembly. The trigger bar 100 may include a front end 105, a rear end 107, a top portion 109, and a bottom portion 111.

FIG. 1A shows a top view of the repositioned cruciform 208 (shown by solid lines) relative to the OEM cruciform 108 (shown by dashed lines) on the OEM trigger bar 100. For example, the repositioned cruciform 208 may be moved forward about 0.040" about the body 102 of the trigger bar 100 towards the front end 105 of the trigger bar 100. The repositioned cruciform 208 may be moved any suitable distance forward on the body 102 of the trigger bar 100. In some instances, a front portion of the repositioned cruciform 208 may be attached to the body 102 of the trigger bar 100 at or near the start of a lateral bend about the rear end 107 of the body 102 of the trigger bar 100. In this manner, the repositioned cruciform 208 may be generally forward of the OEM cruciform 108.

FIG. 1B shows a side view of the repositioned plunger safety tab 206 and sear 212 relative to the OEM plunger safety tab 106 and sear 112 on the OEM trigger bar 100. For example, the repositioned plunger safety tab 206 may be moved forward about 0.040" towards the front end 105 of the trigger bar 100. The repositioned plunger safety tab 206 may be moved any suitable distance forward on the body 102 of the trigger bar 100. In some instances, a front portion of the repositioned plunger safety tab 206 may be attached at or near the start of a lateral bend about the front end 105 of the body 102 of the trigger bar 100. In other instances, a top portion of the repositioned plunger safety tab 206 may extend forward further than the OEM plunger safety tab 106.

In this manner, the repositioned plunger safety tab 206 may be generally forward of the OEM plunger safety tab 106.

Figure 4:
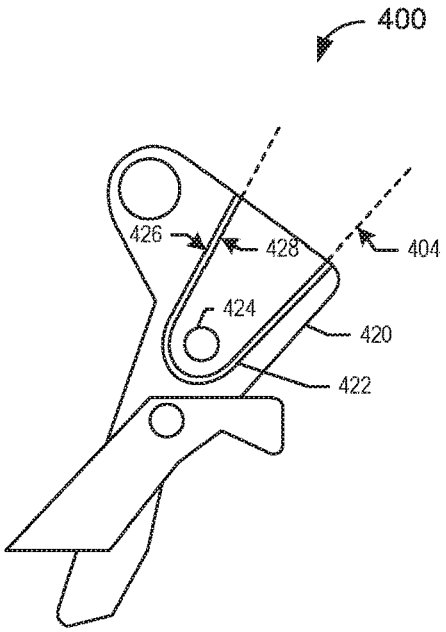
FIG. 4 depicts a trigger shoe, a trigger, and a lateral extending leg of the trigger bar in accordance with one or more embodiments of the disclosure.
Figure 5:
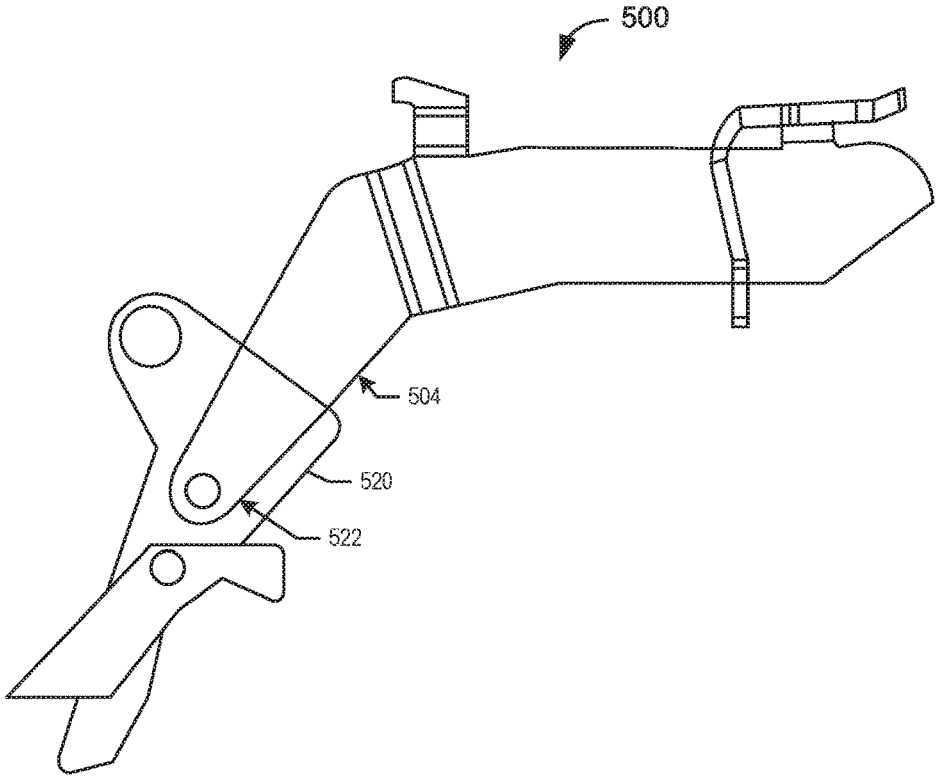
FIG. 5 depicts the trigger bar engaged with the trigger shoe in accordance with one or more embodiments of the disclosure.

In some embodiments, the front end 105 of the trigger bar 100 rests on the front edge of a trigger bar pocket within a trigger shoe (shown in FIGS. 4 and 5). The positioning of the front end 105 of the trigger bar within the trigger bar pocket may contribute to how much slack (or take-up) is in a trigger. For example, if the walls of the trigger bar pocket within the trigger shoe are narrowed, then the slack in the trigger is removed. When one or more walls of the trigger bar pocket are adjusted, the trigger bar 100 components may also be adjusted to ensure the firearm properly functions without accidental discharge. For example, the repositioned plunger safety tab 206 extends further forward than the OEM plunger safety tab 106 to ensure the safety features of the firearm function properly.

In addition, the repositioned sear 212 may be angled upward 109 about 15 degrees relative to the OEM sear 112. The repositioned sear 212 may be angled upward 109 between 0 and 90 degrees, and preferable between 10 and 20 degrees+/−5 degrees. The repositioned sear 212 may be angled upward 109 any suitable angle. In some instances, the repositioned sear 212 may be angled upward and form part of the repositioned cruciform 208.

Figure 2A:
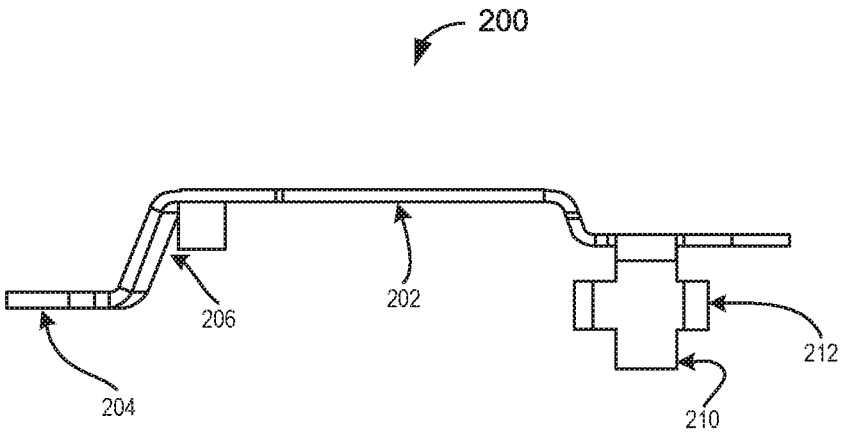
FIG. 2(*a*) depicts a trigger bar for reducing or removing the trigger slack of a firearm in accordance with one or more embodiments of the disclosure.
Figure 2B:
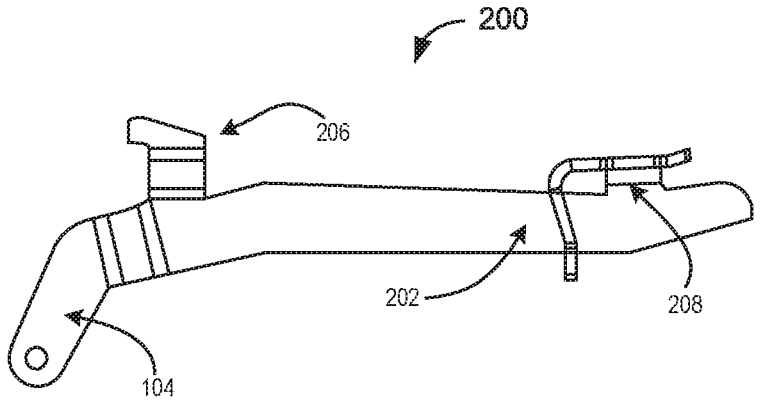

FIGS. 2(*a*) and 2(*b*) depict a trigger bar design 200 with the repositioned components and with illustrative dimensions suitable for most 9 mm Glock® handguns. The dimensions are for illustrative purposes only. The dimensions may vary depending on the style of handgun. For example, any suitable dimensions may be used. FIG. 2(*a*) depicts a top view, whereas FIG. 2(*b*) depicts a side view. As shown in FIGS. 2(*a*) and 2(*b*), the trigger bar 200 may include a body 202, a lateral extending leg 204, a plunger safety tab 206, and a cruciform 208. The lateral extending leg 204 is configured to engage a trigger shoe. The plunger safety tab 206 is configured to engage a striker safety pin. The cruciform 208 is configured to engage a firing pin lug on a striker assembly. The cruciform 208 comprises the cruciform arms 210 and the sear 212.

The laterally extending leg 204 and the trigger shoe may be dimensioned and configured such that, when the trigger bar 200 is properly assembled within a pistol, it will reposition the trigger to remove or substantially reduce any slack in the trigger. Such rearward trigger repositioning in the absence of the present disclosure would result in impairment of the striker safety and the drop safety of the pistol safety system because the plunger safety tab 206 and cruciform 208 would not be properly positioned.

In an exemplary embodiment of the trigger bar 200, the plunger safety tab 206 and the cruciform 208 may be moved forward closer to the lateral extending leg 204 (e.g., by about 0.040 inches), as shown in FIGS. 1A and 1B relative to an OEM Glock® trigger bar, to ensure proper alignment and engagement with the striker safety pin and the slot in the trigger housing (and thus the firing pin lug on the striker assembly). The plunger safety tab 206 and the cruciform 208 may be moved forward closer to the lateral extending leg 204 any suitable distance between about 0 to 0.10 inches, which distance may vary based on the particular handgun model. For instance, the distance on a Glock® G21 may be different than that of a Glock® G19. The distance the plunger safety tab 206 and the cruciform 208 are moved forward may be dependent on the configuration of the laterally extending leg 204 with respect to the trigger shoe, as well as the configuration of the leg 204 with respect to the body 202 of the trigger bar 200.

In other embodiments, the sear 212 may be angled upward between 0° and 20° from the plane defined by the cruciform arms 210 to more positively engage the firing pin lug as the cruciform arm 210 slideably moves within the slot of the trigger housing, being moved up and down by the ledge formed in the slot.

Figure 3A:
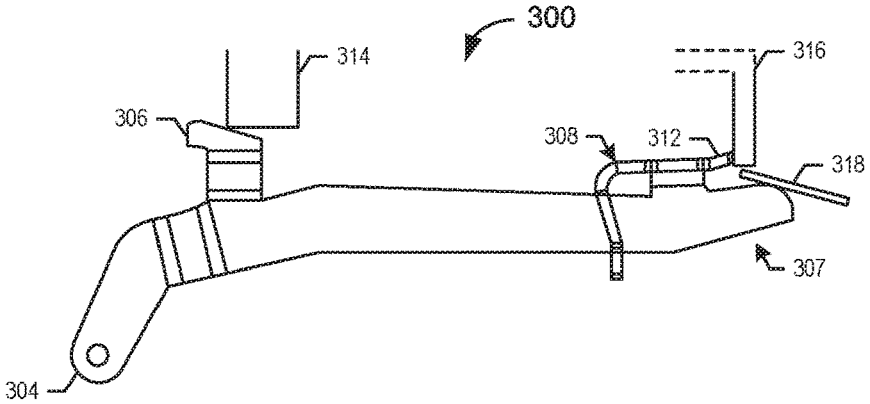
FIG. 3A depicts a trigger bar before a trigger is engaged in accordance with one or more embodiments of the disclosure.

FIG. 3A shows a trigger bar 300 at rest within a firearm. In this position, the trigger bar 100 has a firing pin safety 314 resting on the plunger safety tab 306. As the trigger bar 300 is engaged via a trigger (not shown) attached to the lateral extending leg 304, the firing pin safety 314 moves traverse to the direction of the trigger bar (e.g., vertically) to move from the path of the firing pin (not shown). The firing pin safety 314 moves along the angled surface of the plunger safety tab 306. In one embodiment, as shown in FIG. 1B, the plunger safety tab 106 was moved 0.040 inches from the OEM's original placement to engage the firing pin safety. In other embodiments, the plunger safety tab 106 could move more or less than 0.040 inches in either direction along the trigger bar 100. Further, in FIG. 3A, the sear 312 is engaged with a striker 316. In some embodiments, as in FIG. 1A, the sear 112 is planer with the cruciform 108 or is angled 15 degrees+/−5 degrees away from the cruciform 108. The angled sear 312, as seen in FIG. 3A, fully engages with the striker 316. In some embodiments, as the trigger bar 300 moves in a rearward direction within the firearm, the sear holds the striker 316 in place.

Figure 3B:
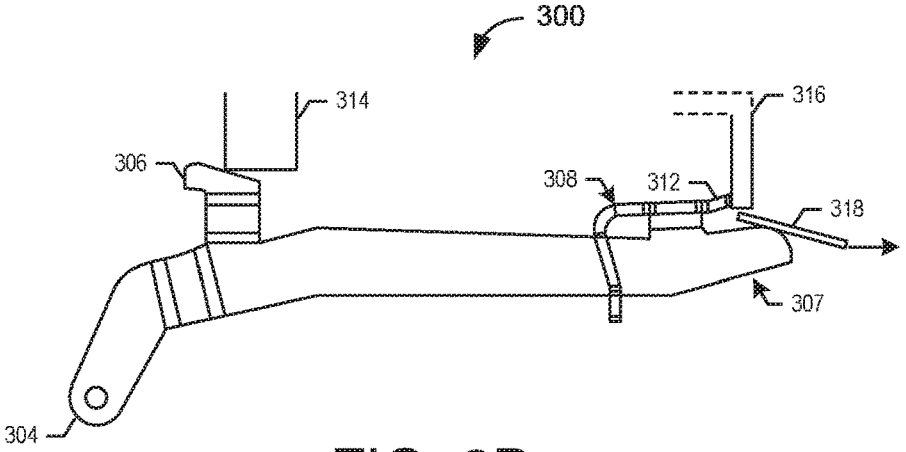
FIG. 3B depicts the trigger bar during the trigger engagement in accordance with one or more embodiments of the disclosure.
Figure 3C:
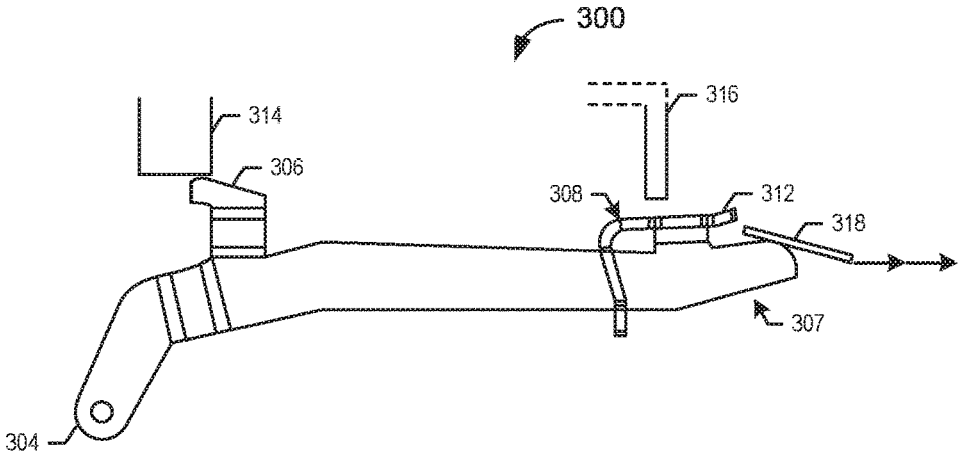
FIG. 3C depicts the trigger bar after the trigger has been fully engaged in accordance with one or more embodiments of the disclosure.

As seen in FIGS. 3A-3C, in one embodiment, as the rear end 307 of the trigger bar slides along the connector 318 within the firearm, the trigger bar 300 slides at a downward angle within the firearm. In some embodiments, since the plunger safety tab 314 and the cruciform 308 are moved at least 0.040 inches towards the lateral extending leg 304, the firearm engages the connector much quicker than the OEM provides within the firearm. One benefit to the trigger bar 300 being closer or touching the connector 318 is a faster trigger pull. In some embodiments, the trigger bar 300 rear end 307 touches the connector 318 before the trigger is engaged by a user. In other embodiments, the trigger bar 300 is 0.01 inches to 0.05 inches closer to the connector without touching the connector. After the trigger has been fully engaged, as shown in FIG. 3C, the firing pin safety 314 is resting on top of the plunger safety tab 306 and the sear 312 disengages the striker 316. Once the sear 312 disengages the striker, the firing pin (not shown) within the firearm strikes the primer of a bullet within the firearm. A benefit to the displacement of the plunger safety tab 306 and the cruciform is faster engagement between the trigger and the connector 318 and thus faster firing of the firearm.

In some embodiments, as seen in FIG. 4, the lateral extending leg 404 (represented by dashed lines) extends into the trigger shoe 420 of a firearm. For example, the lateral extending leg 404 slides into a trigger bar pocket 422 of the trigger shoe 420. In some instances, as seen in FIG. 4, the walls of the trigger bar pocket 422 are spaced apart from the lateral extending leg 404 when in a repose position. In other instances, as seen in FIG. 5, the lateral extending leg 504 fits snuggly against the walls of the trigger bar pocket 522 of the trigger shoe 520 when in the repose position. The further the forward wall in the trigger pocket is spaced apart from the forward wall of the laterally extending leg 404, the larger the trigger slack. That is, trigger slack is the delay between movement of the trigger and engagement of the trigger bar.

In some embodiments, as seen in FIG. 4, the front wall 426 of the trigger bar pocket 422 within the trigger shoe 420 is moved in a rearward direction. As used herein, "rearward direction" means towards the butt of a firearm. The front wall 426 may be moved in the rearward direction between 0.01 inch-1 inch. The front wall 426 may be moved closer to the front side 428 of the lateral extending leg 404. In some embodiments, the front wall 426 may abut the front side 428 of the lateral extending leg 404. In some instances, the lateral extending leg 404 may be moved rearward so the trigger bar 404 will start in the position as seen in FIG. 3B. In other instances, the lateral extending leg 404 is pushed rearward and the plunger safety tab 306 is moved away from the rearward position to configure the trigger bar 300 to start in the position as seen in FIG. 3A. A benefit to the front wall 426 of the trigger bar pocket 422 being moved in a rearward direction is less trigger slack between engagement of the trigger and the lateral extending leg 404. In turn, reducing trigger slack between the engagement of the trigger and the lateral extending leg 404, results in the trigger bar disengaging the firing pin assembly and safety pin assembly quicker, as seen sequentially in FIGS. 3A-3C.

As seen in FIG. 5, the trigger bar 500 is engaged with the trigger shoe 520 where the trigger bar 500 is configured to move as soon as the trigger shoe 520 moves in either direction. The lateral extending leg 504 connects to the trigger shoe 520 by abutting the forward wall of the trigger bar pocket 522. In some instances, the trigger bar pocket 522 matches a portion of the lateral extending leg 504. In other instances, the wall distance between the trigger bar pocket 522 and a part of the lateral extending leg 504 are different. When one or more walls of the trigger bar pocket 422/522 is adjusted, the plunger safety tab 506 and the cruciform 510 can be adjusted to allow the firearm to still function properly. For example, if the walls of the trigger bar pocket 422/522 are adjusted 0.04 inches, then the plunger safety tab 506 and the cruciform 510 may also be adjusted 0.04 inches to ensure the firearm safety mechanisms still function properly. The adjustment within the trigger bar pocket 522 and components of the trigger bar can vary between 0.01 inch and 1 inch.

In this manner, when in battery, the front edge of the trigger bar comes to rest on the front edge of the trigger bar pocket machine into the trigger shoe. The position of the inner wall of the shoe dictates the amount of trigger take up that can be removed. The further back the position the wall, the more take-up that can be removed. The more take-up that is removed, the more unsafe the trigger may become. The further back the trigger bar is positioned, the further away, or off, the safety ledge of the trigger block of the cruciform on the trigger bar. Also, the portion of the trigger bar that depresses the plunger safety on the slide starts to engage the further back the trigger bar is positioned, effectively disengaging the primary safety of the firearm (e.g., Glock®) fire control system.

To prevent disengaging both safeties, and to create a better, safer trigger, the cruciforms and the plunger safety tab on the trigger bar are moved back to, or as close to OEM location as possible, which are more forward on the trigger bar.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A method for reducing or removing trigger slack in a pistol, the method comprising:

repositioning a plunger safety tab to a front end of a body of a trigger bar, wherein the plunger safety tab is repositioned towards the front end of the body of the trigger bar from a first position to a second position;

and repositioning a cruciform coupled to a rear end of the body, wherein the cruciform is repositioned towards the front end of the body from a first location to a second location.

2. The method of claim 1, wherein the plunger safety tab comprises:

a first portion extending in a lateral direction from the body of the trigger bar;

a second portion extending substantially perpendicular from the first portion; and a third portion extending towards the front end of the body.

3. The method of claim 1, wherein the cruciform comprises a sear.

4. The method of claim 3, further comprising angling the sear 0-20 degrees relative to a surface proximate to the sear on the cruciform.

5. The method of claim 1, wherein the cruciform comprises a center flat portion and at least three cruciform arms extending away from the center flat portion.

6. The method of claim 5, wherein the at least three cruciform arms comprises:

a first arm angled in a first direction perpendicular to the center flat portion;

a second arm extending away from the center flat portion; and a sear angled in a second direction opposite the first arm.

7. The method of claim 6, wherein the first arm is configured to engage a spring within the pistol.

8. The method of claim 1, wherein the rear end of the body of the trigger bar is configured to engage a connector of the pistol.

9. A method for reducing or removing trigger slack in a firearm, the method comprising:

repositioning a plunger safety tab towards a front end of a body of a trigger bar relative to a first position of the plunger safety tab;

repositioning a cruciform coupled to a rear end of the body, wherein the cruciform is repositioned towards the front end of the body relative to a first location of the cruciform; and angling a sear upward between about 0 to 20 degrees relative to a surface proximate to the sear on the cruciform.

10. The method of claim 9, wherein the cruciform comprises a center flat portion and at least three cruciform arms extending away from the center flat portion.

11. The method of claim 10, wherein the at least three cruciform arms comprises:

a first arm angled in a first direction perpendicular to the center flat portion;

a second arm extending away from the center flat portion; and the sear angled in a second direction opposite the first arm.

12. The method of claim 11, wherein the first arm is configured to engage a spring within the firearm.

13. The method of claim 9, wherein the plunger safety tab comprises:

a first portion extending in a lateral direction from the body of the trigger bar;

a second portion extending substantially perpendicular from the first portion; and a third portion extending towards the front end of the body.

14. The method of claim 9, wherein the rear end of the body of the trigger bar is configured to engage a connector of the firearm.

15. The method of claim 9, further comprising a lateral extending leg disposed about the front end of the body, wherein the lateral extending leg comprises an aperture.

16. The method of claim 15, wherein the body of the trigger bar comprises a center point, wherein the lateral extending leg and the cruciform are offset from the center point in a parallel direction to the center point.

17. A method for reducing or removing trigger slack in a pistol, the method comprising:

repositioning a plunger safety tab by moving the plunger safety tab 0.04 inches forward towards a front end of a body of a trigger bar relative to a first position of the plunger safety tab;

repositioning a cruciform by moving the cruciform 0.04 inches forward towards the front end of the body of the trigger bar relative to a first location of the cruciform; and angling a sear upward between about 0 to 20 degrees relative to a surface of the cruciform.

18. The method of claim 17, further comprising a lateral extending leg disposed about the front end of the body, wherein the lateral extending leg comprises an aperture.

19. The method of claim 18, wherein the body of the trigger bar comprises a center point, wherein the lateral extending leg and the cruciform are offset from the center point in a parallel direction to the center point.

20. The method of claim 17, wherein the cruciform comprises at least three cruciform arms comprising:

a first arm angled in a first direction perpendicular to the center flat portion;

a second arm extending away from the center flat portion; and a sear angled in a second direction opposite the first arm.

* * * * *